US010494883B2

(12) United States Patent
Macpherson et al.

(10) Patent No.: US 10,494,883 B2
(45) Date of Patent: Dec. 3, 2019

(54) WIRED PIPE AUTO-STABBING GUIDE

(71) Applicants: John D. Macpherson, Spring, TX (US); Manfred G. Prammer, Downingtown, PA (US)

(72) Inventors: John D. Macpherson, Spring, TX (US); Manfred G. Prammer, Downingtown, PA (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 155 days.

(21) Appl. No.: 14/947,056

(22) Filed: Nov. 20, 2015

(65) Prior Publication Data

US 2017/0145761 A1 May 25, 2017

(51) Int. Cl.

| | |
|---|---|
| ***E21B 17/00*** | (2006.01) |
| ***E21B 17/02*** | (2006.01) |
| ***E21B 17/04*** | (2006.01) |
| ***E21B 19/16*** | (2006.01) |
| ***E21B 17/042*** | (2006.01) |

(52) U.S. Cl.

CPC ..... *E21B 19/161* (2013.01); *E21B 17/003* (2013.01); *E21B 17/028* (2013.01); *E21B 17/042* (2013.01); *E21B 19/165* (2013.01)

(58) Field of Classification Search

CPC .... E21B 19/161; E21B 17/003; E21B 17/028; E21B 17/042

See application file for complete search history.

(56) References Cited

U.S. PATENT DOCUMENTS

| | | | | |
|---|---|---|---|---|
| 5,092,399 | A * | 3/1992 | Lang | E21B 19/10 166/77.53 |
| 6,276,466 | B1 * | 8/2001 | Boyd | E21B 47/01 166/250.01 |
| 7,114,235 | B2 * | 10/2006 | Jansch | E21B 19/164 29/235 |
| 2014/0144537 | A1 * | 5/2014 | Peters | F16L 55/00 138/108 |

OTHER PUBLICATIONS

Shah, et al. "Design Considerations for a New High Data Rate LWD Acoustic Telemetry System" SPE 88636. SPE Asia Pacific Oil and Gas Conference and Exhibition held in Perth, Australia, Oct. 18-20, 2004. 7 pages.

* cited by examiner

*Primary Examiner* — David J Bagnell
*Assistant Examiner* — Yanick A Akaragwe
(74) *Attorney, Agent, or Firm* — Canot Colburn LLP

(57) ABSTRACT

A wired pipe joining system for joining wired pipe segments having first end, a second end, a first coupler in the first end, a second coupler in the second end, and a transmission medium in communication with the first and second couplers. The system includes: a lower clamp configured to hold a top pipe segment; a top rotation arm to guide a first end of a new pipe segment into a second end of a top pipe segment; a top coupler measurement device configured to connect to a second end of the new pipe segment and receive a signal from a second coupler in the second end of the new pipe segment; and a controller that causes the top rotation arm to move the new pipe segment to cause the signal received by the top coupler measurement to be maximized.

9 Claims, 5 Drawing Sheets

WIRED PIPE AUTO-STABBING GUIDE

BACKGROUND

During subterranean drilling and completion operations, a pipe or other conduit is lowered into a borehole in an earth formation during or after drilling operations. Such pipes are generally configured as multiple pipe segments to form a "string", such as a drill string or production string. As the string is lowered into the borehole, additional pipe segments are coupled to the string by various connection mechanisms, such as threaded couplings. Such coupling is referred to as "make up". During make up, stabbing guides are used to aid human workers in aligning pin to box threads and preventing face damage and connection failure.

An iron roughneck is a piece of hydraulic machinery used to automatically connect and disconnect segments of pipe in a modern drilling operation. In more detail, an iron roughneck allows for pipe segments to be manipulated as they are hoisted into and out of a borehole without having a human directly manipulating the segments. Such iron roughnecks may be controlled by external controllers. One issue, however, that may still require human intervention is that while automatic, the roughnecks may not be adept at aligning the segments such that face damage does not occur.

Various power and/or communication signals may be transmitted through the pipe segments via a "wired pipe" configuration. Such configurations include electrical, optical or other conductors extending along the length of selected pipe segments or string segments. The conductors are operably connected between pipe segments by a variety of configurations.

One such configuration includes a threaded male-female configuration often referred to as a pin-box connection. The pin box connection includes a male member, i.e., a "pin end" that includes an exterior threaded portion, and a female member, i.e., a "box end", that includes an interior threaded portion and is configured to receive the pin in a threaded connection.

Some wired pipe configurations include a transmission device mounted on the tip of the pin end as well as in the box end. The transmission device, or "coupler," can transmit power, data or both to an adjacent coupler. The coupler in the pin end is typically connected via a coaxial cable or other means to the coupler in the box end.

BRIEF DESCRIPTION

Disclosed herein is a wired pipe joining system for joining wired pipe segments having first end, a second end, a first coupler in the first end, a second coupler in the second end, and a transmission medium in communication with the first and second couplers. The system includes a lower clamp configured to hold a top pipe segment and a top rotation arm to guide a first end of a new pipe segment into a second end of a top pipe segment. The system also includes a top coupler measurement device configured to connect to a second end of the new pipe segment and receive a signal from a second coupler in the second end of the new pipe segment and a controller that causes the top rotation arm to move the new pipe segment to cause the signal received by the top coupler measurement to be maximized.

Also disclosed is a method of joining wired pipe segments having first end, a second end, a first coupler in the first end, a second coupler in the second end, and a transmission medium in communication with the first and second couplers. The method includes: placing a top pipe segment into a lower clamp of a pipe joining device; placing a new pipe segment into a top rotation arm of the pipe joining device; causing a signal to be presented on a second coupler of the top pipe segment; determining an amplitude of the signal as received by a top coupler measurement device coupled to a second end of the new pipe segment; moving the new pipe segment to maximize the amplitude; and rotating the new pipe segment to join it to the top pipe segment.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed system, apparatus and method are presented herein by way of exemplification and not limitation with reference to the Figures.

Figure 1:
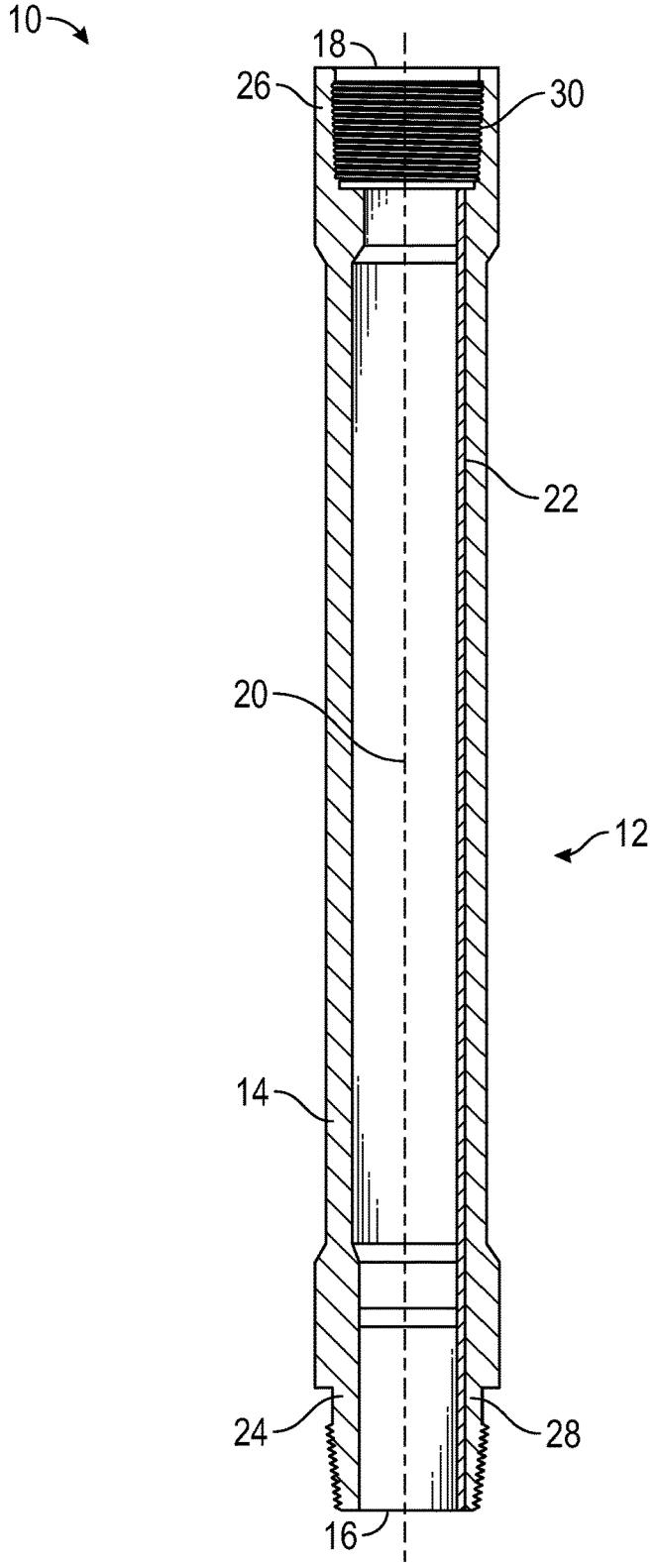
FIG. 1 depicts an exemplary embodiment of a wired pipe segment of a well drilling and/or logging system.

Referring to FIG. 1, an exemplary embodiment of a portion of a well drilling, logging and/or production system 10 includes a conduit or string 12, such as a drillstring or production string, that is configured to be disposed in a borehole for performing operations such as drilling the borehole, making measurements of properties of the borehole and/or the surrounding formation downhole, or facilitating gas or liquid production.

For example, during drilling operations, drilling fluid or drilling "mud" is introduced into the string 12 from a source such as a mud tank or "pit" and is circulated under pressure through the string 12, for example via one or more mud pumps. The drilling fluid passes into the string 12 and is discharged at the bottom of the borehole through openings in a drill bit located at the downhole end of the string 12. The drilling fluid flows up between the string 12 and the borehole wall and is discharged into the mud tank or other location.

The string 12 may include at least one wired pipe segment 14 having an uphole end 18 and a downhole end 16. As described herein, "uphole" refers to a position that is above another location and "downhole" refers to a location below another location. It shall be understood that the uphole end 18 could be below the downhole end 16 without departing from the scope of the disclosure herein.

At least an inner bore or other conduit 20 extends along the length of each segment 14 to allow drilling mud or other fluids to flow therethrough. A transmission line 22 is located within the wired segment 14. In one embodiment, the transmission line 22 is a coaxial cable. In another embodiment, the transmission line 22 is formed of any manner of carrying power or data, including, for example, a twisted pair. In the case where the transmission line 22 is a coaxial cable it may include an inner conductor surrounded by a dielectric material. The coaxial cable may also include a shield layer that surrounds the dielectric material. In one embodiment, the shield layer is electrically coupled to an outer conductor that may be formed, for example, by a rigid or semi-rigid tube of a conductive material.

The segment 14 includes a downhole connection 24 and an uphole connection 26. The segment 14 is configured so that the uphole connection 26 is positioned at an uphole location relative to the downhole connection 24. The downhole connection 24 includes a male connection portion 28 having an exterior threaded section, and is referred to herein as a "pin end" 24. The uphole connection 26 includes a female connection portion 30 having an interior threaded section, and is referred to herein as a "box end" 26.

The pin end 24 and the box end 26 are configured so that the pin end 24 of one wired pipe segment 14 can be disposed within the box end 26 of another wired pipe segment 14 to effect a fixed connection therebetween to connect the segment 14 with another adjacent segment 14 or other downhole component. In one embodiment, the exterior of the male connection portion 28 and the interior of the female connection portion 30 are tapered. Although the pin end 24 and the box end 26 are described has having threaded portions, the pin end 24 and the box end 26 may be configured to be coupled using any suitable mechanism, such as bolts or screws or an interference fit.

In one embodiment, the system 10 is operably connected to a downhole or surface processing unit which may act to control various components of the system 10, such as drilling, logging and production components or subs. Other components include machinery to raise or lower segments 14 and operably couple segments 14, and transmission devices. The downhole or surface processing unit may also collect and process data generated by the system 10 during drilling, production or other operations.

As described herein, "drillstring" or "string" refers to any structure or carrier suitable for lowering a tool through a borehole or connecting a drill bit to the surface, and is not limited to the structure and configuration described herein. For example, a string could be configured as a drillstring, hydrocarbon production string or formation evaluation string. The term "carrier" as used herein means any device, device component, combination of devices, media and/or member that may be used to convey, house, support or otherwise facilitate the use of another device, device component, combination of devices, media and/or member. Exemplary non-limiting carriers include drill strings of the coiled tube type, of the jointed pipe type and any combination or portion thereof. Other carrier examples include casing pipes, wirelines, wireline sondes, slickline sondes, drop shots, downhole subs, BHA's and drill strings.

Figure 2:
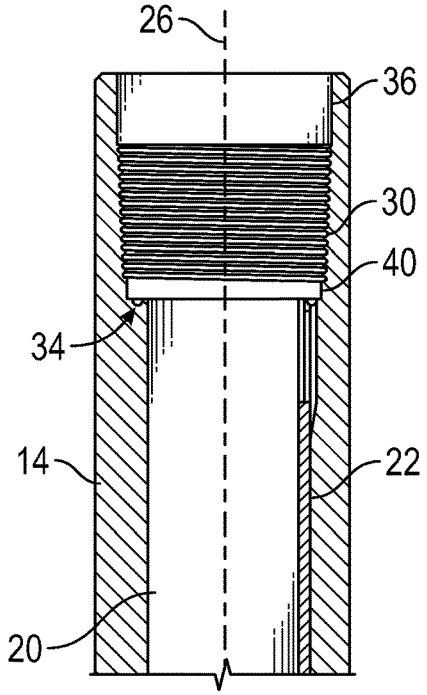
FIG. 2 depicts an exemplary embodiment of a box end of the segment of FIG. 1.
Figure 3:
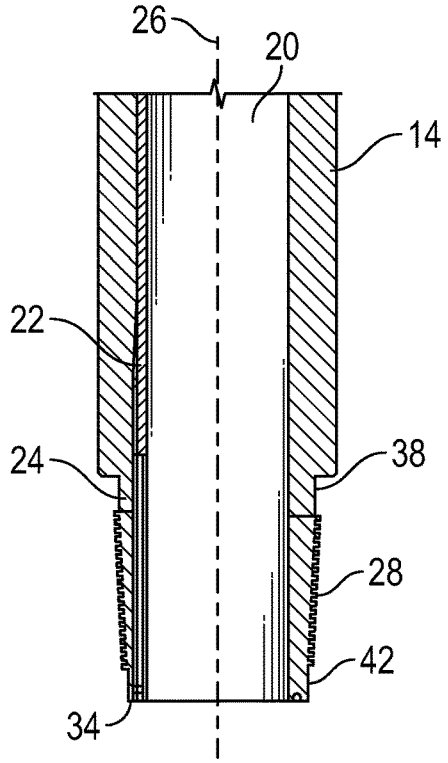
FIG. 3 depicts an exemplary embodiment of a pin end of the segment of FIG. 1.

Referring to FIGS. 2 and 3, the segment 14 includes at least one transmission device 34 (also referred to as a "coupler" herein) disposed therein and located at the pin end 24 and/or the box end 26. The transmission device 34 is configured to provide communication of at least one of data and power between adjacent segments 14 when the pin end 24 and the box end 26 are engaged. The transmission device 34 may be of any suitable type, such as an inductive coil, direct electrical (e.g., galvanic) contacts and an optical connection ring. The coupler may be disposed at the inner or outer shoulder. Further, the transmission device 34 may be a resonant coupler.

Figure 4:
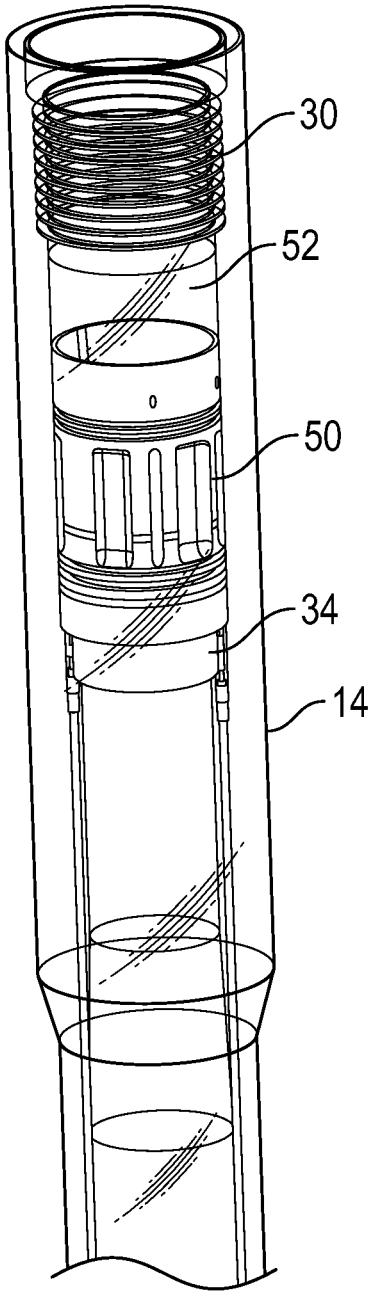
FIG. 4 shows a perspective view of a box end of pipe segment having a repeater disposed therein.

It shall be understood that the transmission device 34 could also be included in a repeater element 50 disposed between adjacent segments 14 (e.g, within the box end) as shown FIG. 4. In such a case, the data/power is transmitted from the transmission device in one segment, into the repeater. The signal may then be passed "as is," amplified, and/or modified in the repeater and provided to the adjacent segment 14.

As illustrated in FIG. 2, the transmission device 34 is located at or near an inner shoulder 40 of the box end 18. During makeup, an end 42 of the pin end 16 may be close to or in contact with the inner shoulder 40.

Regardless of the configuration, it shall be understood that each transmission device 34 can be connected to one or more transmission lines 22. Embodiments disclosed herein are directed to how the transmission lines 22 can be formed and disposed in a segment 14. In one embodiment, the transmission line 22 is capable of withstanding the tensile, compression and torsional stresses and superimposed dynamic accelerations typically present in downhole tools when exploring oil, gas or geothermal wells.

In one embodiment, the transmission line 22 includes a wire channel (e.g., an outer protective layer) and a transmission element. The transmission element can be selected from one of coaxial cable, twisted pair wires, and individual wires. The following description is presented with respect to coaxial wire but it shall be understood that the teachings herein are applicable to any type of transmission element.

As shown in FIG. 4, the box end 18 includes a region 52 between the threads 30 and shoulder 40. As shown, a repeater element 50 is provided. The repeater 50 may be capable of repeating signals received from other repeaters and/or couplers and/or may be capable of generating a signal. In one embodiment, the repeater 50 includes a coupler in each of its ends.

Figure 5:
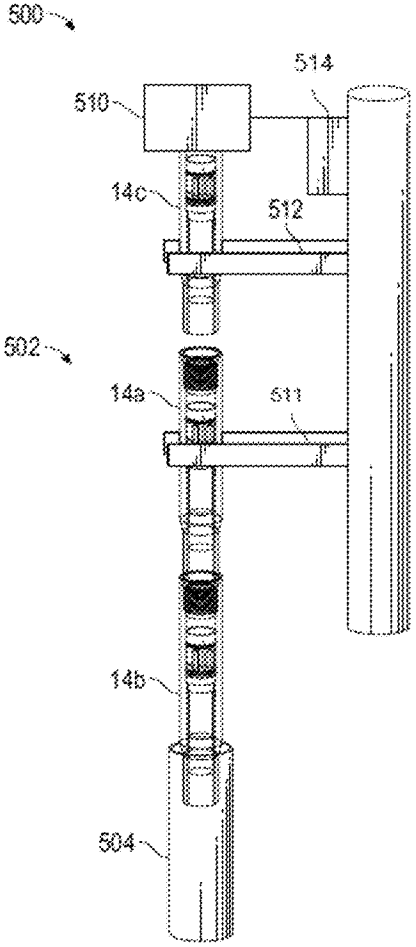
FIG. 5 shows a simplified block diagram of an automated segment joining device according to one embodiment.

FIG. 5 shows a simplified example of a pipe joining device 500 being used in the assembly/disassembly of a drill string 502. The drill string 502 is formed of a plurality of segments 14 that may be of the type shown in any of FIGS. 1-4. That is, the drill string includes at least one wired pipe segment and may include one or more repeaters. The illustrated drill string 502 also includes a bottom hole assembly 504. A bottom hole assembly (or BHA) generally includes one or more sensors and computing devices that are used while drilling a borehole. Herein it shall be assumed that the BHA is capable of generating a signal that may be transmitted to a top segment of the drill string 502. In the illustrated example, the top segment is labeled as 14*a*.

In practice, pipe joining (and unjoining) devices are commonly referred to as iron roughnecks and may be referred as such from time to time herein. In general, iron roughnecks use a rotary table and torque wrench(es) to make up or break down a drill string. As illustrated, the joining device 500 includes a lower clamp 511 that clamps the top segment 14*a* and a top rotation arm 512 that rotates pipe segment 14*c* to either join it to top segment 14*a* or to remove it from the top segment 14*a*.

The following description relates to adding segments to the drill string 502. In general, known pipe joining devices (e.g., iron roughnecks) work for their intended purposes. In some instances, the top rotation arm 512 may include the ability to move the end bottom end of the new segment 14*c* in one or both the x and y directions (see FIG. 6), or combinations thereof, to line up the new segment 14*c* and the top segment 14*a* during make up. However, in some instances they may not exactly line up the pin end of the new segment 14*c* with the box end of top segment 14*a*. In such a case, the threads of one or both the pin end of new segment 14*c* or box end of top segment 14*a* or other parts of the segments may be damaged. The term "new segment" has been applied above to a single segment 14*c*. It shall be understood that the segment could include more that one element and could be, for example a so-called "pipe stand" in certain instances. To that end, the term "new segment" as used herein includes both pipe stands and single pipe segments.

Herein, either the BHA 504 or a repeater 50 (FIG. 4) in the drillstring 502 includes circuitry that generates a signal that is identifiable. As the joining device 500 moves the new segment 14*c* closer to the top segment 14*a* a signal strength of the signal from a coupler in the top segment 14*a* received by the new segment 14*c* may increase. By measuring the signal strength the new segment 14*c* may be aligned by the joining device 500 to possibly reduce or eliminate some of the problems described above. To that end, the joining device 500 may include a top coupler measurement device 510 that attaches to and receives a signal from a coupler in the box end of the new segment 14*c* (or a repeater in the box end). The strength of that signal can be quantified by a positioning controller 514 of the joining device 500. It is assumed, that the when the signal is at its highest, the new segment 14*c* and the top segment 14*a* are best aligned. Of course, other metrics could be used to determine the best alignment.

Figure 6:
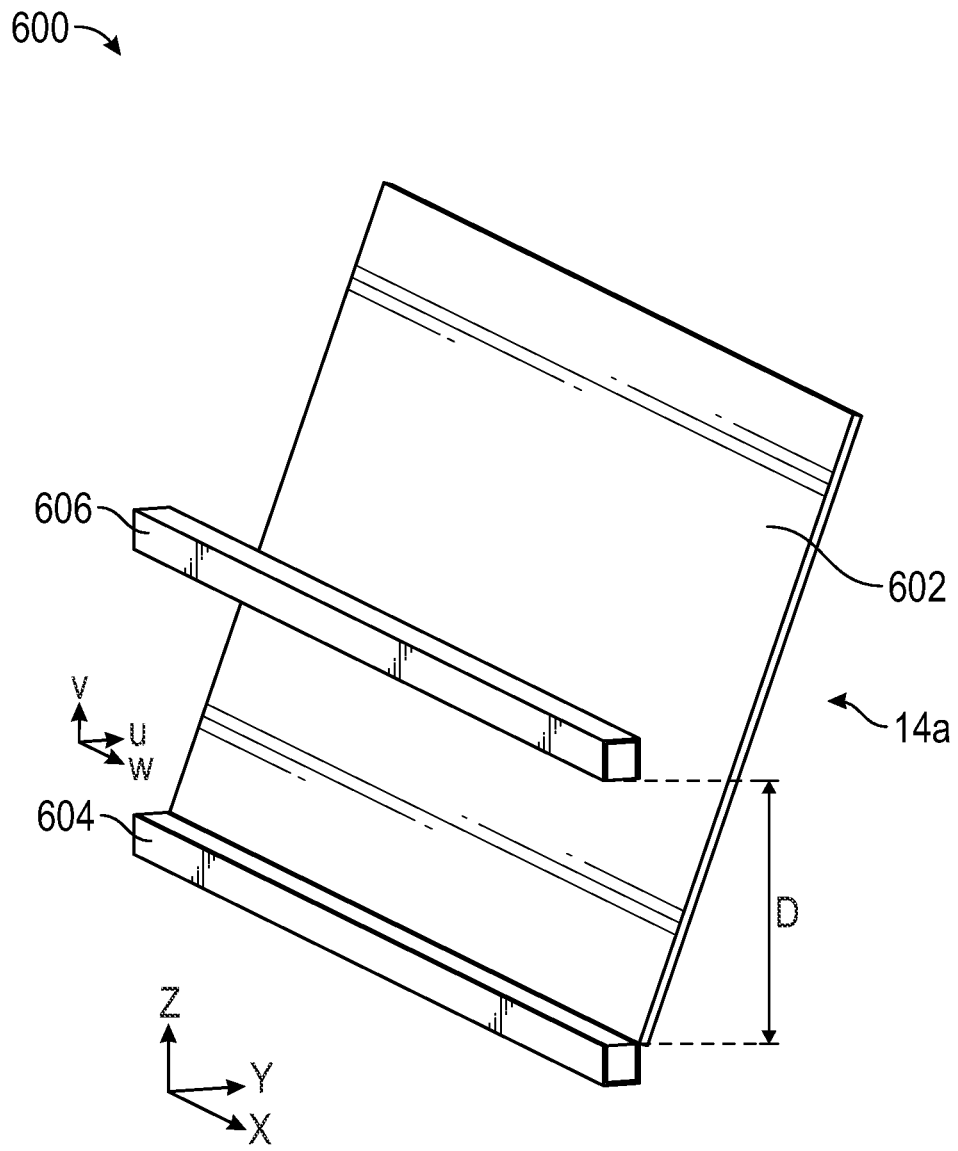
FIG. 6 shows a simplified version of a box end of a top segment and a coupler from a new segment.

FIG. 6 shows a simplified (linear) version of a box end 600 of a top segment 14*a*. The box end 600 includes a threaded wall that terminates at or near a coupler 604 located in the box end 600. The coupler could be in an inner shoulder of the box end or could be located in a repeater depending on the situation. Regardless, it shall be assumed that the coupler 604 is the vertically highest coupler in the assembled drill string. Also shown is a simplified (linear) version of a coupler 606 that may be contained in a new segment being added to a drill string. This coupler can be called a new segment coupler from time to time herein. As the distance D between the coupler 604 and the new segment coupler 606 gets closer, the amplitude of the signal received by new segment coupler 606 will increase. Similarly, the more closely the couplers 606, 604 are vertically aligned the larger the received signal will be. To that end, the new segment coupler 606 may be moved by the joining device 500 in the x and y directions to maximize the received signal. With reference to both FIGS. 5 and 6, the positioning controller 514 may cause the upper rotation arm 512 to move the end of the new segment 14*c* such that the signal sensed by top coupler measurement device 510 is maximized or indicates alignment via another metric.

Set forth below are some embodiments of the foregoing disclosure:

Embodiment 1: A wired pipe joining system for joining wired pipe segments having first end, a second end, a first coupler in the first end, a second coupler in the second end, and a transmission medium in communication with the first and second couplers, the system comprising: a lower clamp configured to hold a top pipe segment; a top rotation arm to guide a first end of a new pipe segment into a second end of a top pipe segment; a top coupler measurement device configured to connect to a second end of the new pipe segment and receive a signal from a second coupler in the second end of the new pipe segment; a controller that causes the top rotation arm to move the new pipe segment to cause the signal received by the top coupler measurement to be maximized.

Embodiment 2: The wired pipe joining system of embodiment 1, wherein the second coupler is in a repeater in a box end of the new pipe segment.

Embodiment 3: The wired pipe joining system of embodiment 1, wherein the signal received from the second coupler is generated by a repeater in the top pipe segment.

Embodiment 4: The wired pipe joining system of embodiment 1, wherein the signal received from the second coupler is generated by a bottom hole assembly.

Embodiment 5: The wired pipe system of embodiment 1, wherein at least one of the first and second couplers in the top pipe segment is an inductive coupler.

Embodiment 6: The wired pipe system of embodiment 1, wherein at least one of the first and second couplers in the top pipe segment is a resonant coupler.

Embodiment 7: A method of joining wired pipe segments having first end, a second end, a first coupler in the first end, a second coupler in the second end, and a transmission medium in communication with the first and second couplers, the method comprising: placing a top pipe segment into a lower clamp of a pipe joining device; placing a new pipe segment into a top rotation arm of the pipe joining device; causing a signal to be presented on a second coupler of the top pipe segment; determining an amplitude of the signal as received by a top coupler measurement device coupled to a second end of the new pipe segment; moving the new pipe segment to maximize the amplitude; and rotating the new pipe segment to join it to the top pipe segment.

Embodiment 8: The method of embodiment 7, wherein the signal received by the top coupler measurement device is generated by a repeater in the top pipe segment.

Embodiment 9: The method of embodiment 7, wherein the signal received by the top coupler measurement device is generated by a bottom hole assembly.

Embodiment 10: The method of embodiment 7, wherein at least one of the first and second couplers in the top pipe segment is an inductive coupler.

Embodiment 11: The method of embodiment 7, wherein at least one of the first and second couplers in the top pipe segment is a resonant coupler.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A wired pipe joining system for joining wired pipe segments having first end, a second end, a first signal transmission device in the first end, a second signal transmission device in the second end, and a transmission medium in communication with the first and second signal transmission devices, the system comprising:

a lower clamp configured to hold a top pipe segment;

a top rotation arm to guide a first end of a new pipe segment into a second end of a top pipe segment;

a top coupler measurement device configured to connect to a second end of the new pipe segment and receive a signal from the second signal transmission device in the second end of the top pipe segment; and a controller that causes the top rotation arm to move the new pipe segment to cause the signal received by the top coupler measurement device to be maximized.

2. The wired pipe joining system of claim 1, wherein the signal transmission device is in a repeater in a box end of the top pipe segment.

3. The wired pipe system of claim 1, wherein at least one of the first and second signal transmission devices in the top pipe segment is an inductive coupler.

4. The wired pipe system of claim 1, wherein at least one of the first and second signal transmission devices in the top pipe segment is a resonant coupler.

5. A method of joining wired pipe segments having first end, a second end, a first signal transmission device in the first end, a second signal transmission device in the second end, and a transmission medium in communication with the first and second signal transmission devices, the method comprising:

placing a top pipe segment into a lower clamp of a pipe joining device;

placing a new pipe segment into a top rotation arm of the pipe joining device;

causing a signal to be presented on the second signal transmission device of the top pipe segment;

determining an amplitude of the signal as received by a top coupler measurement device coupled to a second end of the new pipe segment;

moving, due to a controller, the new pipe segment to maximize the amplitude; and rotating the new pipe segment to join it to the top pipe segment.

6. The method of claim 5, wherein the signal received by the top coupler measurement device is generated by a repeater in the top pipe segment.

7. The method of claim 5, wherein the signal received by the top coupler measurement device is generated by a bottom hole assembly.

8. The method of claim 5, wherein at least one of the first and second signal transmission device in the top pipe segment is an inductive coupler.

9. The method of claim 5, wherein at least one of the first and second signal transmission device in the top pipe segment is a resonant coupler.

* * * * *